US005257734A

United States Patent [19]

Bartle

[11] Patent Number: 5,257,734

[45] Date of Patent: Nov. 2, 1993

[54] WASTE PAPER BINS

[76] Inventor: Andrew D. Bartle, 2 East Cottage, Clearwell, Coleford, England

[21] Appl. No.: 842,344

[22] PCT Filed: Oct. 15, 1990

[86] PCT No.: PCT/GB90/01585

§ 371 Date: Mar. 25, 1992

§ 102(e) Date: Mar. 25, 1992

[87] PCT Pub. No.: WO91/05499

PCT Pub. Date: May 2, 1991

[30] Foreign Application Priority Data

Oct. 18, 1989 [GB] United Kingdom ..... 8923508

[51] Int. Cl.[5] ..... B65D 5/42; B65D 43/02

[52] U.S. Cl. ..... 229/109; 229/23 R; 229/907

[58] Field of Search ..... 229/23 R, 23 BT, 109, 229/110, 907; 220/908

[56] References Cited

U.S. PATENT DOCUMENTS

| | | | |
|---|---|---|---|
| 1,911,073 | 5/1938 | Dyment . | |
| 2,214,220 | 9/1940 | Beaman | 229/23 R |
| 2,357,092 | 7/1942 | Mian et al. . | |
| 2,459,727 | 1/1949 | Tillery | 229/23 R |
| 2,657,849 | 11/1953 | Paul et al. | 229/23 R |
| 2,726,803 | 12/1955 | Ketler | 229/23 R |
| 2,735,607 | 2/1956 | Wasyluka | 229/23 R |
| 2,751,138 | 6/1956 | Laver | 229/109 |
| 3,261,533 | 7/1966 | Repking | 229/23 BT |
| 3,907,194 | 9/1975 | Davenport et al. | 229/23 BT |
| 4,009,818 | 3/1977 | Rogers | 229/23 R |
| 4,134,531 | 1/1979 | Martinez et al. | 229/23 BT |
| 4,657,176 | 4/1987 | Matsubara | 220/908 |
| 4,742,951 | 5/1988 | Kelly et al. | 229/23 R |
| 4,976,355 | 12/1990 | Crutchfield | 229/907 |
| 5,050,775 | 9/1991 | Marquardt | 229/110 |

FOREIGN PATENT DOCUMENTS

| | | |
|---|---|---|
| 0322972 | 7/1989 | European Pat. Off. . |
| 3045168 | 7/1982 | Fed. Rep. of Germany . |
| 158210 | 4/1988 | Norway . |
| 375439 | 4/1975 | Sweden . |

*Primary Examiner*—Gary E. Elkins
*Attorney, Agent, or Firm*—Young & Thompson

[57] ABSTRACT

A waste paper bin of large capacity comprises a base 2 having side walls 5, a bottom wall 4, and a removable lid 3. The bottom wall and the removable lid are each formed by folding a sheet of flexible material. The lid has side walls 11 for overlapping the side walls 5 of the base 2 when the lid is fitted to the base. The bin is formed from an inexpensive sheet material, such as cardboard, so as to be semi-disposable. The bin may be replaced by a fresh bin when it becomes worn, without requiring substantial expenditure. A decorative pattern or motif may be applied to the sheet material.

10 Claims, 2 Drawing Sheets

WASTE PAPER BINS

FIELD OF THE INVENTION

This invention relates to waste paper bins.

BACKGROUND OF THE INVENTION

Waste paper bins are very widely used as receptacles for receiving paper and other waste which is thrown away, for example during the course of office work or at exhibitions or other public gatherings. The quantity of waste paper which is thrown away under particular conditions can be considerable, particularly under conditions in which a large quantity of computer printout is produced. Most existing waste paper bins are not capable of accommodating such large quantities of waste paper, and, as a result, offices, exhibition sites and the like can become littered with paper overflowing from such bins.

SUMMARY OF THE INVENTION

It is an object of the invention to provide a novel waste paper bin which can easily be produced at low cost and so as to have a large capacity for waste paper, and which can moreover be decorated with an eye-catching motif, if required.

According to the present invention there is provided a waste paper bin comprising a base having side walls formed from a sheet of flexible material by folding and a bottom wall having sides which engage the insides of the side walls, characterised by a removable lid also formed from a sheet of flexible material and having a top formed with a cut out through which waste paper may be introduced into the bin and sides in overlapping relationship with the side walls of the base.

Such a bin is advantageously formed from an inexpensive sheet material, such as cardboard, so as to be semi-disposable, that is so that the bin may be replaced by a fresh bin when it becomes worn, without requiring substantial expenditure. This renders the bin particularly suitable for use at temporary exhibitions. In addition, a decorative pattern or motif may be applied to the sheet material so as to give the bin an attractive or eye-catching appearance. It is envisaged that, in certain applications, the pattern or design applied to the bin may have a promotional purpose.

BRIEF DESCRIPTION OF THE DRAWINGS

In order that the invention may be more fully understood, a preferred form of waste paper bin in accordance with the invention will now be described, by way of example, with reference to the accompanying drawings, in which.

DETAILED DESCRIPTION OF THE INVENTION

Figure 1:
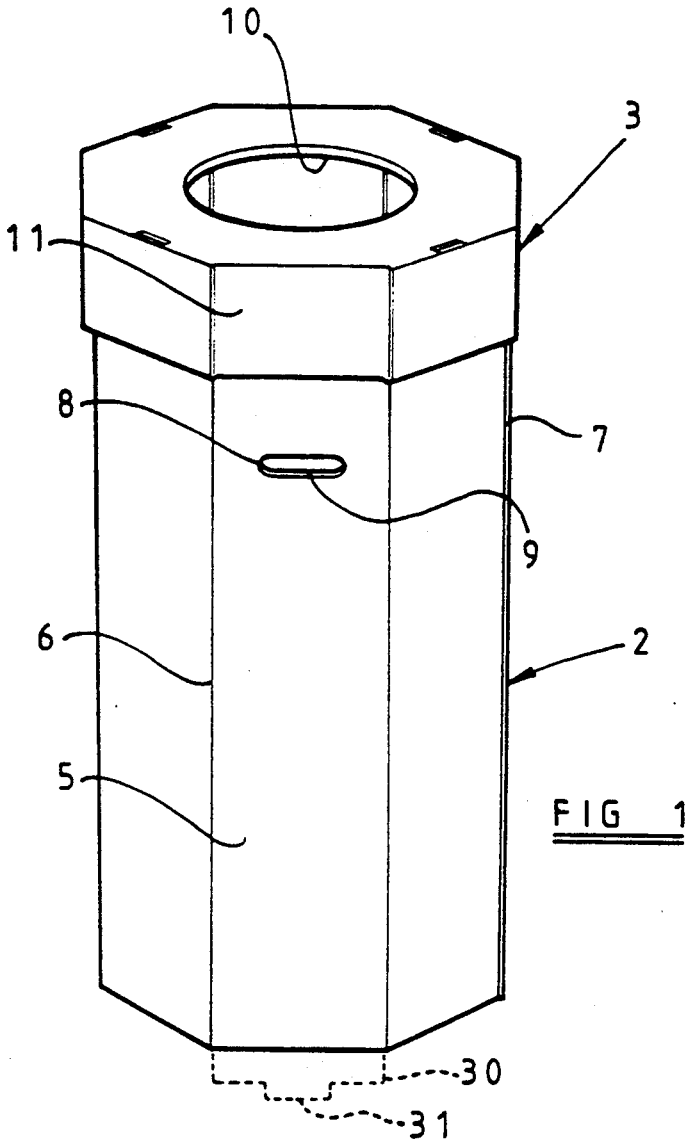
FIG. 1 is a perspective view of the bin.
Figure 3:
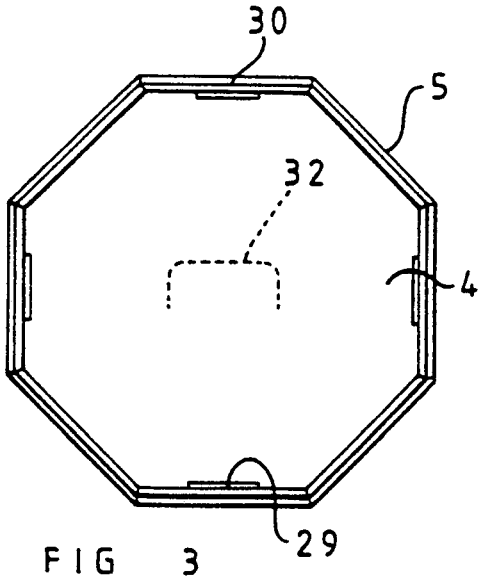

Referring to FIG. 1, the bin comprises a base 2 and a removable lid 3, the base 2 having a bottom wall 4 (see FIG. 3). The base 2 has eight side walls 5 formed from a single rectangular cardboard sheet by folding along parallel lines 6 and bonding the opposite edges of the sheet together by applying adhesive along an overlap 7. Two hand holds 8 are formed in opposite side walls 5 by cutting substantially U-shaped slits 9 and folding under the cardboard within the slits 9.

The removable lid 3 is formed with a circular cut out 10 and has side walls 11 which overlap the side walls 5 of the base 2 when the lid 3 is fitted on the base 2. The side walls 11 of the lid 3 are formed by cutting and folding in a manner which will now be described with reference to FIG. 4.

Figure 4:
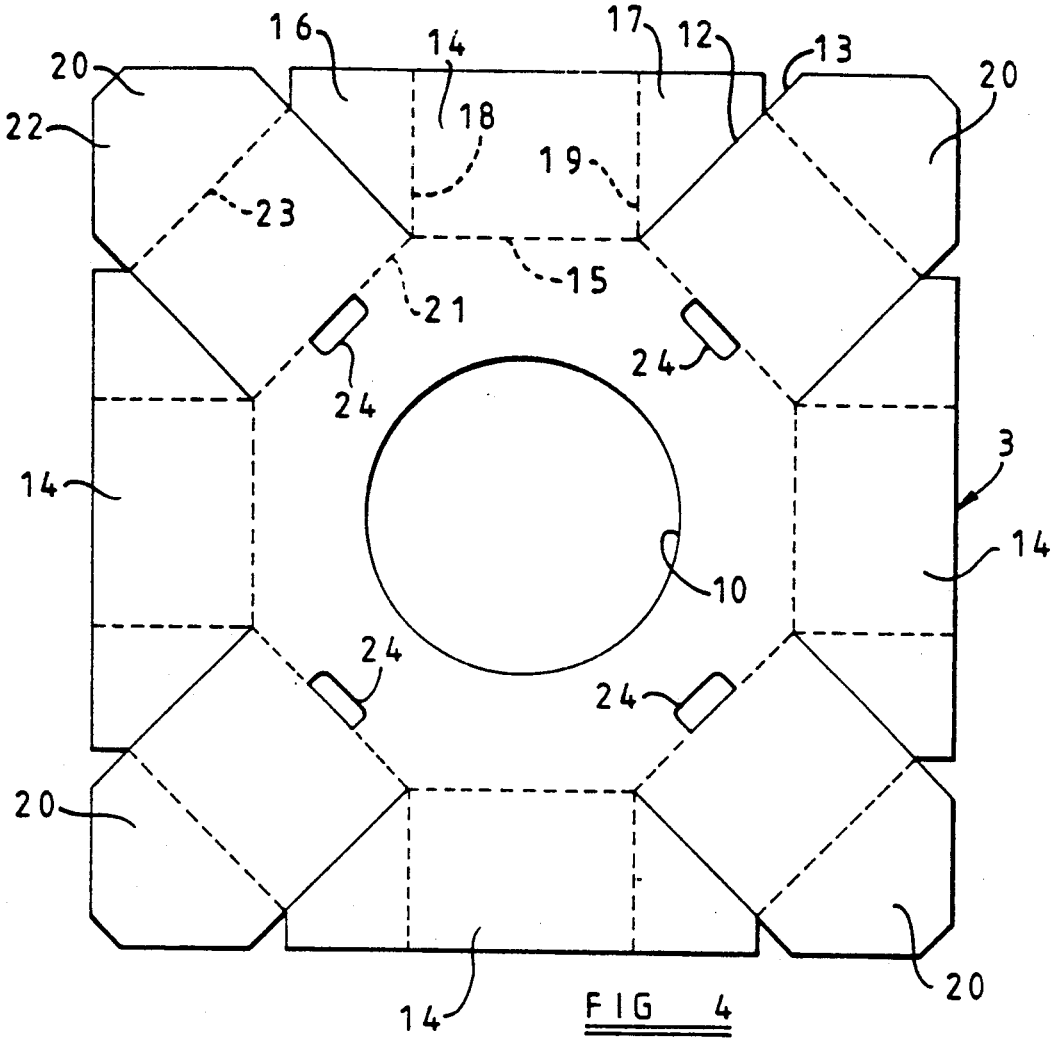
FIGS. 4 and 5 show cardboard sheets from which the lid and the bottom wall of the bin are formed.

Referring to FIG. 4, the lid 3 is formed from a substantially square cardboard sheet with a circular cut out 10 by forming eight slits 12 and eight triangular cut outs 13 as shown, and by first folding inward the four intermediate sheet portions 14 along their fold lines 15 until the portions 14 are substantially upright at right angles to the remainder of the sheet. Two extensions 16 and 17 at opposite sides of the portion 14 are then folded slightly inwards along the fold lines 18 and 19. Next the four intermediate sheet portions 20 are folded inwardly along their fold lines 21 so that they lie adjacent the extensions 16 and 17 of the adjacent portions 14, and the tabs 22 of the sheet portions 20 are folded inwardly along their fold lines 23 and over the extensions 16 and 17 before being tucked into slots 24 formed in the sheet for this purpose.

Figure 2:
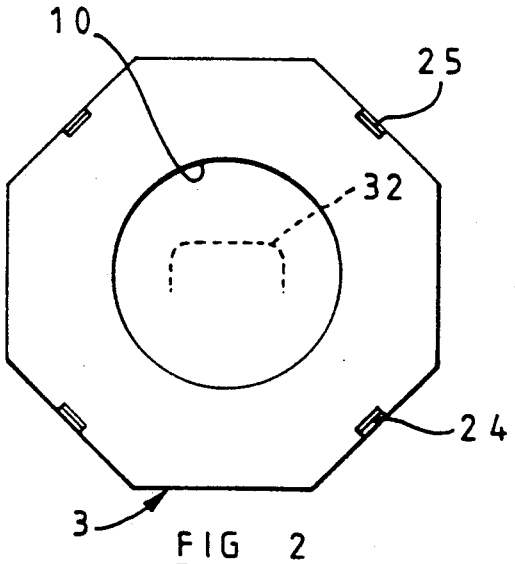
FIGS. 2 and 3 are respectively top and bottom views of the bin.

In this manner not only are the sheet portions 20 held in their required upright positions but also these portions 20 serve to hold the sheet portions 14 in the required position by trapping their extensions 16 and 17 under the tabs 22. The slots 24 can be seen in FIG. 2 with the ends 25 of the tabs 22 engaged therein.

Figure 5:
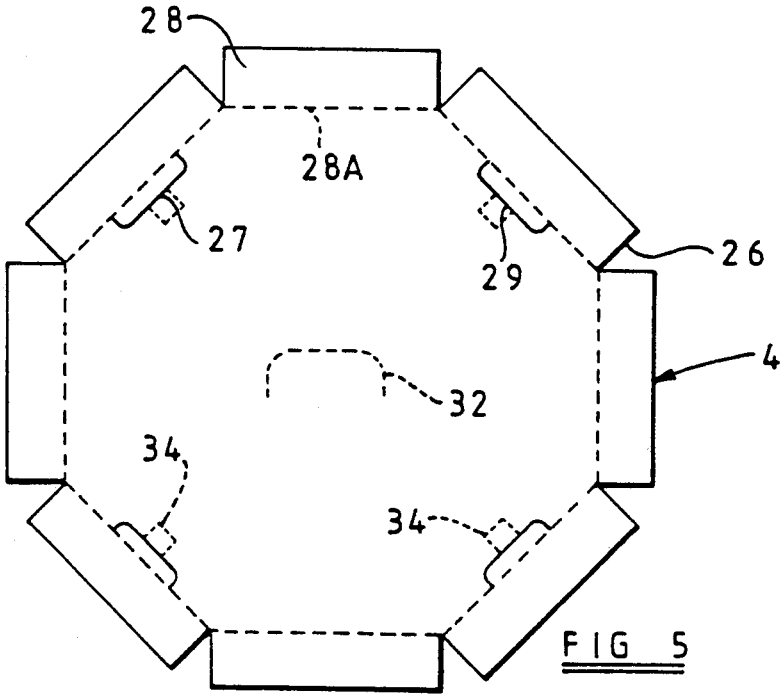

Referring to FIG. 5, the bottom wall 4 is formed from a cardboard sheet in the shape of an octagon by cutting eight triangular cut outs 26 and four substantially U-shaped slits 27 as shown, and by folding flaps 28 inwardly along fold lines 28A so that they lie at right angles to the remainder of the bottom wall 4. The portions within the slits 27 are thereby caused to pivot with the flaps 28 so as to form slots 29 for receiving tabs on the side walls 5 as will be described below.

The side walls 5 of the base 2 are formed with flaps along their lower edges, only one of which is shown in broken lines at 30 in FIG. 1 by way of example. Four of these flaps 30 are also formed with tabs 31 as also shown in FIG. 1. The bottom wall 4 is located in position within the lower part of the base 2 by introducing the bottom wall 4 with the flaps 28 in their folded positions within the side walls 5, and by then folding the flaps 30 on the side walls 5 inwardly so that they overlap the flaps 28 and so that those flaps 30 having tabs 31 are located so that the tabs 31 engage within the slots 29 in the bottom wall 4.

Positive engagement of the tabs 31 within the slots 29 can be ensured by forcing the bottom wall 4 firmly against the edges of the flaps 30. If necessary, a hand hold may be formed in the bottom wall 4 by punching through the perforation 32 in the centre of the bottom wall 4 to form a U-shaped slit, so that the hand hold may be used to pull the bottom wall 4 against the edges of the flaps 30. In any case positive locking of the tabs 31 within the slots 29 will be provided by the weight of any object resting on the bottom wall 4 within the bin. When folding in the flaps 30, it is important to ensure that the four flaps 30 without tabs 31 are folded in before the four flaps 30 with tabs 31 as this ensures that the latter flaps 30 hold the former in their required positions. FIG. 3 shows the bottom wall 4 securely held in position by engagement with the flaps 30.

Perforated portions 34 may also be provided in the bottom wall 4 to enable the bin to be secured to the ground by passing one or more wooden pegs through one or more of the perforated portions 34 and into the ground.

I claim:

1. A waste paper bin comprising a base having side walls formed by folding a first sheet of flexible material and a bottom wall having sides which engage inner sides of the side walls, and a removable lid formed from a second sheet of flexible material, said lid having a top formed with a cut out through which waste paper may be introduced into the bin and sides in overlapping relationship with the side walls of the base.

2. A bin according to claim 1, wherein the lid is formed by folding portions of said second sheet of flexible material to form said sides which extend externally of the side walls of the base.

3. A bin according to claim 11, wherein the bottom wall is formed from a third sheet of flexible material by cutting slits extending inwardly from an edge of the third sheet and folding portions of the third sheet inwardly to form said sides of the bottom wall.

4. A bin according to claim 2, wherein the lid is formed from said second sheet of flexible material by cutting slits extending inwardly from an edge of the second sheet and folding portions of the second sheet inwardly to form said sides of the lid.

5. A bin according to claim 4, wherein the folded-in portions of the second sheet are held in position by parts of these portions which are tucked into slots cut in the second sheet.

6. A bin according to claim 5, wherein each part tucked-into a slot forms an extension of an associated side-wall-forming portion and is folded over extensions of adjacent side-wall-forming portions in order to secure the sides of the lid together and retain them in their folded positions.

7. A bin according to claim 1, wherein the side walls of the base are formed by folding said first sheet of flexible material along a series of parallel lines and by joining opposite edges of the first sheet with an adhesive.

8. A bin according to claim 1, wherein hand holds are formed in the base by cutting substantially U-shaped slits in opposite side walls and by turning in parts of the first sheet within the slits.

9. A bin according to claim 1, wherein the bottom wall is held in position by turned-in lower portions of the side walls.

10. A bin according to claim 9, wherein the turned-in lower portions of the side walls overlap the sides of the bottom wall, and the turned-in lower portions have parts which engage in slots formed in the bottom wall.

* * * * *